US005505265A

United States Patent [19]

O'Neil

[11] Patent Number: 5,505,265

[45] Date of Patent: Apr. 9, 1996

[54] FIRE SHIELD ARRAY

[76] Inventor: James E. O'Neil, 1524 W. Commonwealth Ave., Fullerton, Calif. 92633

[21] Appl. No.: 276,427

[22] Filed: Jul. 18, 1994

[51] Int. Cl.[6] ..... A62C 2/06

[52] U.S. Cl. ..... 169/48; 160/351

[58] Field of Search ..... 169/48; 160/135, 160/351; 256/24, 73; 40/610; 52/64, 169.1, 169.2, 169.4

[56] References Cited

U.S. PATENT DOCUMENTS

| | | | |
|---|---|---|---|
| 1,513,446 | 10/1924 | Craft | 40/610 |
| 3,193,017 | 7/1965 | Walker | 169/48 |
| 4,311,199 | 1/1982 | Elias | 169/48 |

FOREIGN PATENT DOCUMENTS

| | | | |
|---|---|---|---|
| 336785 | 10/1930 | United Kingdom | 169/48 |
| 93/14484 | 7/1993 | WIPO | 40/610 |

*Primary Examiner*—Andrew C. Pike

[57] ABSTRACT

A fire shield array includes a plurality of fire shield members interposed between a fire and a structure, wherein each fire shield includes a first frame hingedly mounted to a second frame, the first frame including a corrugated shield interposed within the first frame, the corrugated shield being formed of transparent material and corrugated for strength as well as heat diffusion. First and second leg members pivotally mounted to the second frame are selectively secured to the first frame permitting ease of collapsing for transport and storage of each fire shield.

5 Claims, 4 Drawing Sheets

FIRE SHIELD ARRAY

TECHNICAL FIELD

The field of invention relates to shield apparatus, and more particularly pertains to a fire shield array arranged for positioning about structural buildings and the like to deflect heat directed at such buildings during a surrounding fire situation.

BACKGROUND OF THE INVENTION

Barricade structure for isolating open areas from fire or smoke is set forth within U.S. Pat. No. 5,188,186 having an expandable plate structure.

U.S. Pat. No. 4,364,210 sets forth a fire barrier device that is fixed to walls for receiving conduits, cables, and the like therethrough, wherein the device includes an end cap capable of providing a smoke seal.

U.S. Pat. No. 4,975,316 sets forth a barrier structure formed of multi-layer construction emptoying a woven barrier layer of high density polyethylene sandwiched between outer layers of low density polyethylene.

U.S. Pat. No. 5,187,910 sets forth a barrier system arranged between floor joints and positioned within an expansion joint in a permanent configuration.

SUMMARY OF THE INVENTION

The present invention relates to a plurality of portable shields arranged for positioning interposed between an existing structure or dwelling and a fire to deflect heat directed at the structure minimizing the availability of the fire to elevate temperatures of the structure to a flash point and minimize the availability of the structure for consumption by the fire.

Objects and advantages of this invention will become apparent from the following description taken in conjunction with the accompanying drawings wherein are set forth, by way of illustration and example, certain embodiments of this invention.

The drawings constitute a part of this specification and include exemplary embodiments of the present invention and illustrate various objects and features thereof.

DESCRIPTION OF THE PREFERRED EMBODIMENT

As required, detailed embodiments of the present invention are disclosed herein; however, it is to be understood that the disclosed embodiments are merely exemplary of the invention, which may be embodied in various forms. Therefore, specific structural and functional details disclosed herein are not to be interpreted as limiting, but merely as a basis for the claims and as a representative basis for teaching one skilled in the art to variously employ the present invention in virtually any appropriately detailed structure.

Figure 1:
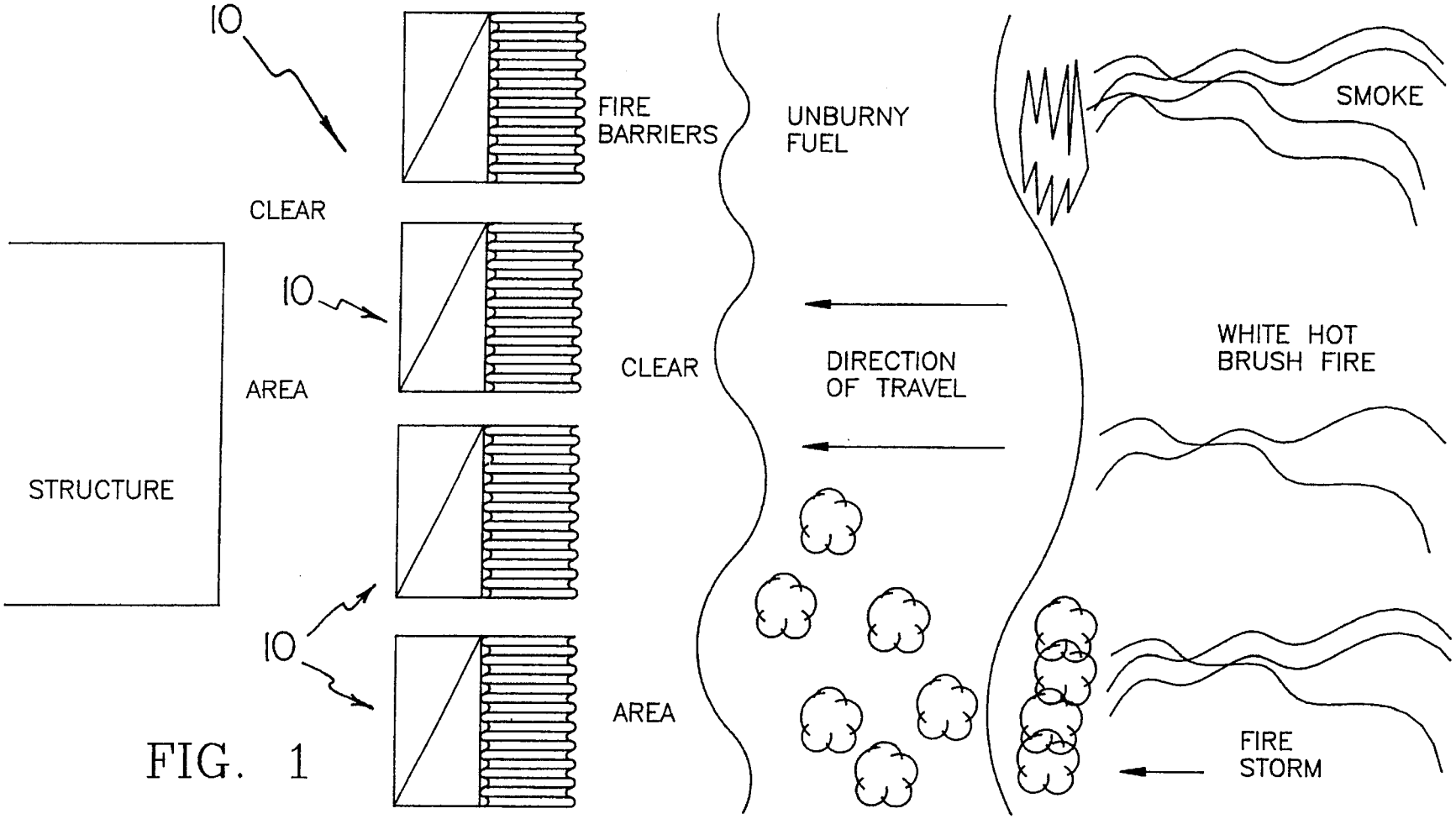
FIG. 1 is an orthographic diagrammatic view of the barrier structure of the invention interposed between a fire and existing structure.

The invention, as indicated in FIG. 1 by the numeral 10, is arranged and interposed between various fires of "white hot brush fire", "fire storm", associated with "smoke", wherein the fire joined typically by wind and the like is directed towards "unburnt fuel" wherein typically due to the urban and suburban sprawl of contemporary society finds various structures and the like that are positioned in adjacency relative to such fires, wherein the proximity of such fires elevates temperatures to fire flash points or proximate such flash points making the danger of fire to such structure and their ultimate destruction a clear hazard. The fire barrier structure of the invention in such a scenario is arranged to be interposed between that structure and the fire as it is directed towards that structure.

Figure 2:
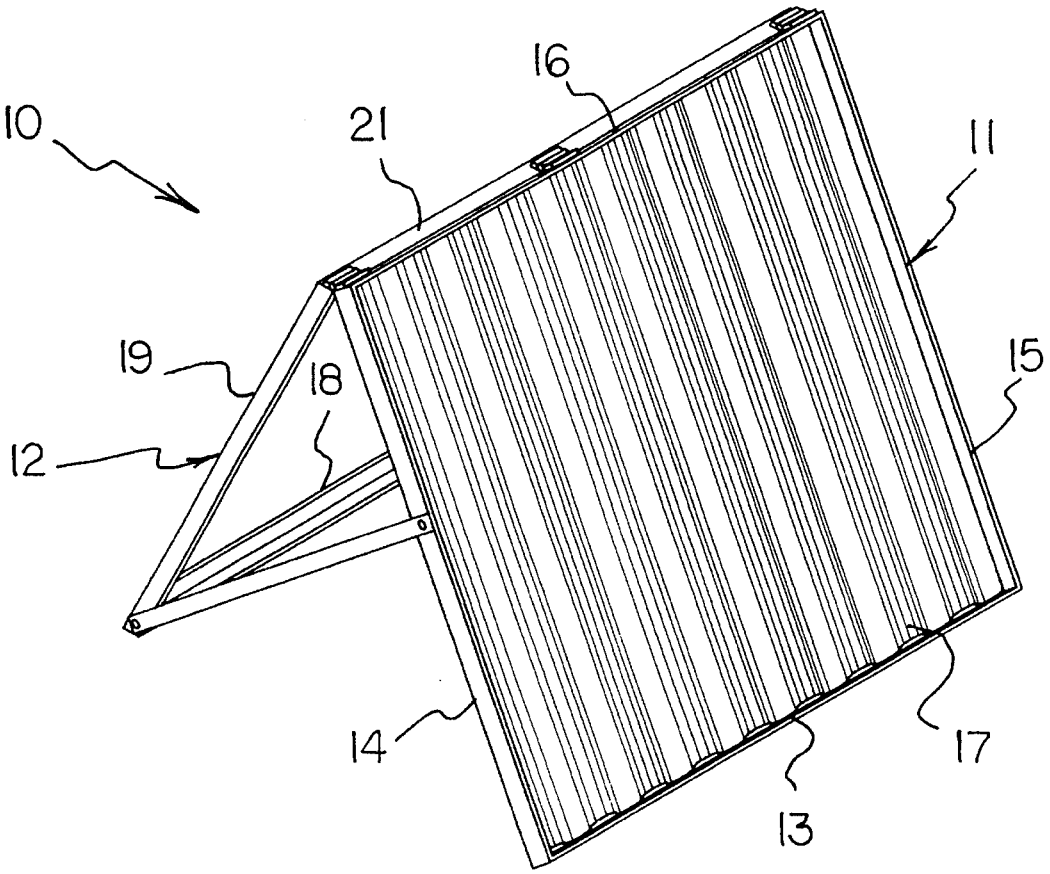
FIG. 2 is an isometric illustration of an individual barrier assembly.
Figure 3:
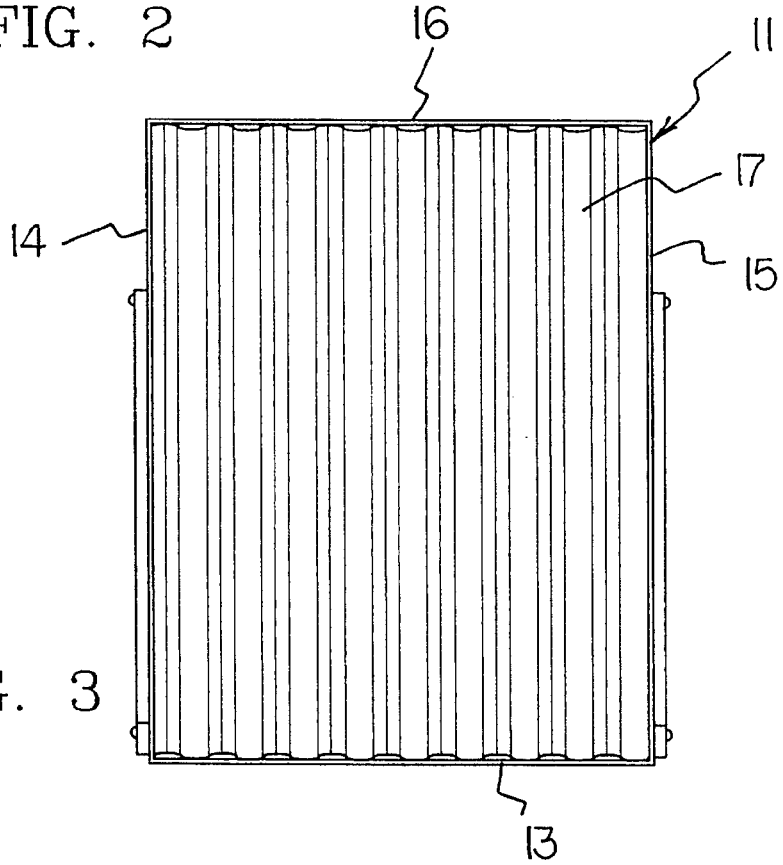
FIG. 3 is an orthographic frontal view of the barrier assembly as indicated in FIG. 2.
Figure 4:
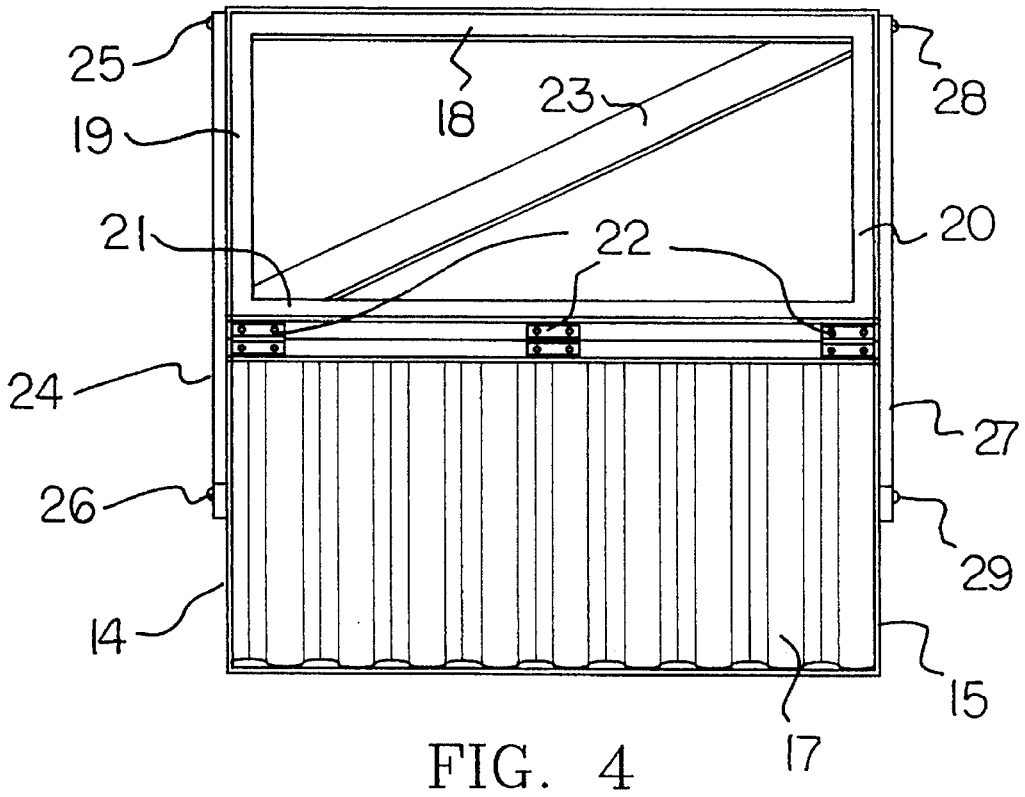
FIG. 4 is an orthographic top view of the barrier assembly.
Figure 6:
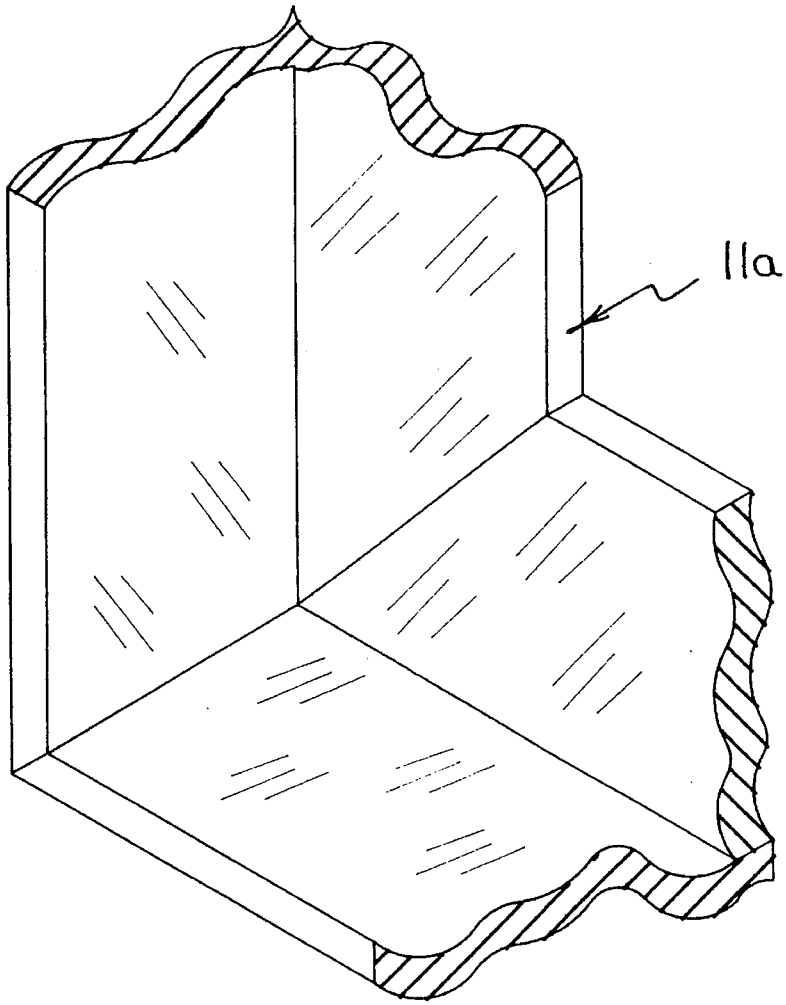
FIG. 6 is an isometric partial view of a modified frame structure formed of transparent material.
Figure 7:
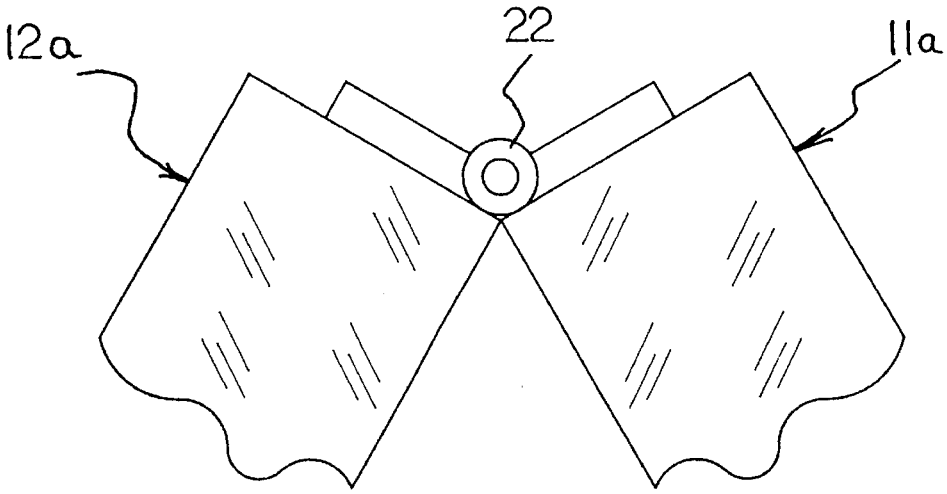
FIG. 7 is an orthographic partial view of the first and second linear frames formed of transparent material connected by an associated hinge structure.

Each barrier of the array of barriers 10 is constructed of a rectilinear first frame 11 pivotally secured to a rectilinear second frame 12. The first frame is formed with a first frame base plate 13, a first frame first side 14, a first frame second side 15, and a first frame top plate 16. A corrugated shield 17 is mounted fixedly coextensively within the first frame 11 and is ideally formed of a transparent material to permit viewing of the oncoming fire permitting individuals to take whatever steps may be necessary to accommodate such fires in terms of safety, removal of equipment, and the like from the associated structure. The corrugated configuration of the shield 17 operates to enhance a diffusion of heat directed at the shield so as to reduce material requirements of the shield. The second frame 12 is formed with a second frame base plate 18, a second frame first side 19 spaced from a second frame second side 20, and a second frame top plate 21. Hinge members 22 pivotally connect the first frame 11 to the second frame 12 and are secured simultaneously to the first frame top plate 16 and the second frame top plate 21, as indicated in FIG. 2. The second frame 2 may also employ a cross brace 23 diagonally directed from the second frame top plate 21 to the second frame base plate 18 to provide rigidity to the second frame structure. Each fire shield is arranged for collapsing and subsequent opening to the configuration illustrated in FIG. 5 or FIG. 2 for example. To this end, the hinge members 22 permit such pivoting of the first frame to the second frame, with a first leg 24 mounted pivotally about a first frame pivot axle 25 to the second frame first side 19, while a second leg 27 pivotally mounted about a second leg pivot axle 28 to the second frame second side 20 is provided. The first leg pivot axle 25 and the second leg pivot axle 28 are positioned in proximity and in adjacency relative to the second frame base plate 18 adjacent lowermost distal ends of the second frame first and second sides 19 and 20, as illustrated and exemplified by the FIG. 5 for example. The first leg 24 is provided with a first leg fastener 26 of any convenient type directed into the first frame first side 14, while the second leg 27 is provided with a second leg fastener 29 directed removaby into the first frame second side 15. The fasteners 26 and 29 are arranged of a convenient type (i.e., screw fasteners, quick release fasteners, nut and bolt type fasteners, etc.) that permit their respective insertion and removal into the respective first and second sides of the first frame 11. The FIGS. 6 and 7 indicate that modified first and second frames 11 and 12 are formed of transparent materials, such that the modified first and second frames 11*a* and 12*a*, as well as the corrugated shield 17, permit ease of viewing in a relatively unobstructed manner of an oncoming fire to permit individuals to assess such danger and take whatever steps may be necessary in terms of safety, material moving, and the like.

Figure 5:
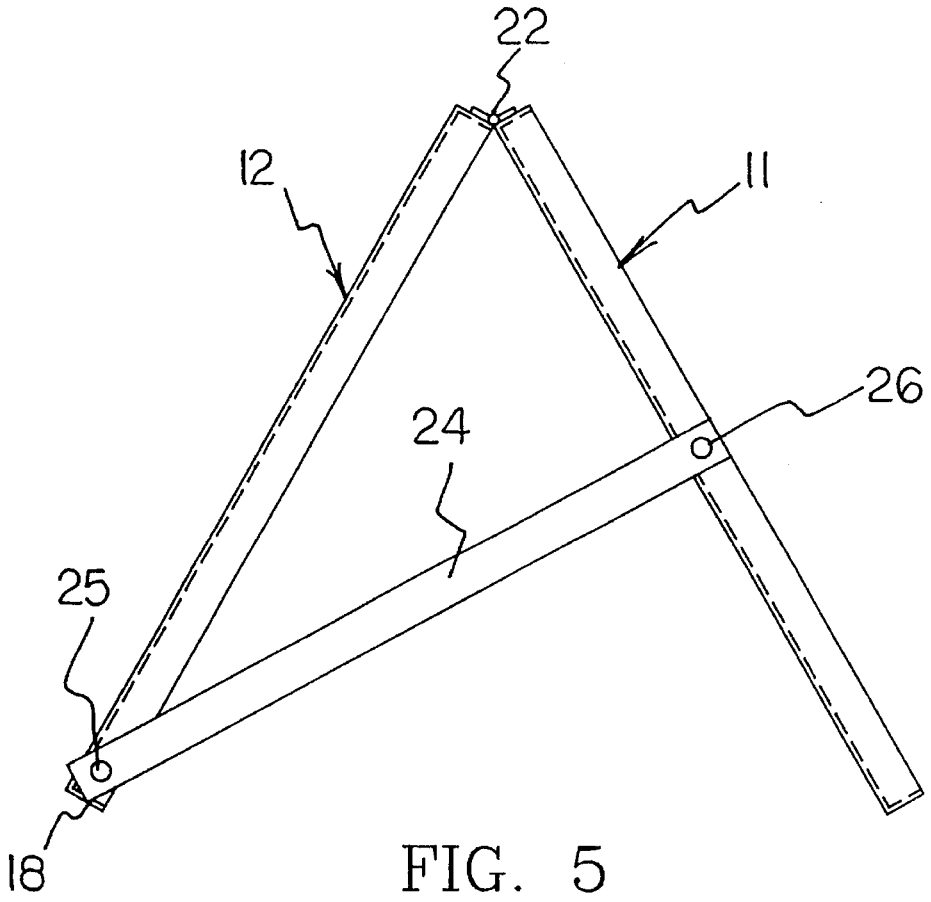
FIG. 5 is an orthographic side view of the barrier assembly.

It should be understood that the fire shield array 10 and individual shield structures, as illustrated in FIG. 5 for example, are dimensioned in as large a configuration as is reasonably handled. To this end, such dimensions are subject to the ability for maneuverability of such fire shields and relative to the size of the structures involved to be protected. Materials may be of any conventional type that accommodate the needs and may of course employ materials to be developed of various composite or individual construction that are available.

It is to be understood that while certain forms of the present invention have been illustrated and described herein, it is not to be limited to the specific forms or arrangement of parts described and shown.

The foregoing is considered as illustrative only of the principles of the invention. Further, since numerous modifications and changes will readily occur to those skilled in the art, it is not desired to limit the invention to the exact construction and operation shown and described, and accordingly all suitable modifications and equivalents may be resorted to, falling within the scope of the invention.

What is claimed and desired to be protected by Letters Patent of the United States is as follows:

1. A fire shield comprising:

a first frame;

a second frame pivotally mounted to the first frame; and a shield member coextensively positioned within the first frame, the shield member being transparent and being corrugated to enhance diffusion of heat directed at the shield member.

2. A fire shield array for use in interposing between a fire and an existing structure to include at least one fire shield, wherein said at least one fire shield comprises:

a first frame hingedly mounted to a second frame, the first frame having a first frame base plate and a first frame top plate, a first frame first side and a first frame second side, the second frame having a second frame top plate spaced from a second frame base plate, and a second frame first side spaced from a second frame second side, with at least one hinge member secured to the first frame top plate and the second frame top plate hingedly mounting the first frame to the second frame, with the first frame having a shield member coextensively positioned within the first frame;

wherein the shield member is transparent and is corrugated to enhance diffusion of heat directed at the shield member.

3. A fire shield array as set forth in claim 2, said at least one fire shield further including a first leg having a first leg pivot axle secured to the second frame first side, with the first leg including a first leg fastener removably secured to the first frame first side.

4. A fire shield array as set forth in claim 3, said at least one fire shield further including a second leg having a second leg pivot axle secured to the second frame second side pivotally mounting the second leg to the second frame, with the second leg having a second leg fastener directed into the first frame second side, with the second leg fastener removably mounted relative to the first frame second side.

5. A fire shield array as set forth in claim 4 wherein the first frame and the second frame are each transparent.

* * * * *